US006964589B1

(12) United States Patent
Lin

(10) Patent No.: US 6,964,589 B1
(45) Date of Patent: Nov. 15, 2005

(54) SCULLING BOAT ASSEMBLY

(76) Inventor: Roger Lin, 12F, No. 55, Lane 110, Anne-Shyang Road, Shindian City, Taipei Hsien (TW)

( * ) Notice: Subject to any disclaimer, the term of this patent is extended or adjusted under 35 U.S.C. 154(b) by 0 days.

(21) Appl. No.: 11/079,114

(22) Filed: Mar. 15, 2005

(51) Int. Cl.[7] ..... B63H 1/36
(52) U.S. Cl. ..... 440/14; 440/21; 440/103
(58) Field of Search ..... 441/13, 14, 15, 441/21, 25, 26, 32

(56) References Cited

U.S. PATENT DOCUMENTS 1,609,330 A * 12/1926 Thibodeau ..... 440/103
2,330,332 A * 9/1943 Boon ..... 440/21
2,696,797 A * 12/1954 Whidden ..... 440/14
6,595,813 B1 * 7/2003 Lekhtman ..... 440/21
6,755,706 B1 * 6/2004 Lin ..... 440/101
6,843,691 B1 * 1/2005 Jelten ..... 440/15

* cited by examiner

*Primary Examiner*—Stephen Avila
(74) *Attorney, Agent, or Firm*—Bacon & Thomas, PLLC

(57) ABSTRACT

A sculling boat assembly is provided to control the traveling direction and drive a boat, and the sculling boat assembly installs a transmission mechanism on two hulls, connects an end of each transmission mechanism to a handle extended from the two hulls, connects another end of each transmission mechanism to a paddle rod extended from the tail of the boat, and connects an end of each paddle rod with an extension of a fin-shape member. Through the transmission of each paddle rod, a user applies a force onto each handle to drive the fin-shape member disposed on each paddle rod for the movements of pushing water outward and enclosing water inward, such that the water resistance is converted into a reaction by the soft and hard materials of the fin-shape member and its extension to drive the boat to move forward rapidly.

8 Claims, 4 Drawing Sheets

SCULLING BOAT ASSEMBLY

FIELD OF THE INVENTION

The present invention generally relates to a sculling boat assembly, and more particularly to a sculling boat assembly having a transmission mechanism installed on two hulls that are aligned in parallel with each other and maintain a predetermined distance apart. An end of each transmission mechanism is coupled with a handle extended from two hulls, and another end of each transmission mechanism is coupled to a paddle rod extended slightly downward from the tail of the boat. An end of each paddle rod is coupled with an extension disposed at an end of a fin-shape member. Therefore, a user just needs to apply a force onto each handle to move it reciprocally along a head and a tail of two hulls to drive the fin-shape member disposed on each paddle rod to create the movements of pushing water outward and enclosing water inward and drive the boat to move forward rapidly.

BACKGROUND OF THE INVENTION

As we know, boat is a sea transportation, which travels under the actions of the buoyancy, gravity and resistance of water, and thus it is necessary to have a motive power for a boat to travel in the sea. At present, most boats such as steamboats, motor vessels, atomic energy boats, and the like are driven by the motive force of an engine. As science, technology and economy are getting advanced, people have higher demands for better quality of life, and thus the leisure and travel industry is booming, not only for tours on land, but also making sea traveling business increasingly popular. Therefore, it comes up manual-control boats, such as sculling boat, wind boat, and sailboat, introduced to the market to meet the purpose for business or entertainment, in order to satisfy the enjoy of controlling the boat by people.

To control the forward and reverse movements of a sculling boat, paddles are generally used for sculling. Hard pedals are usually used for boats of this type, and the hard paddles are made of steel, wood, and plastic steel, etc. Users put the pedals into the water and apply a force to produce a reaction towards the back, so that the paddle surface made of a hard material pedals the water to drive the boat. Further, it is necessary to install coupling rings at appropriate positions of the boat to keep the paddles and bear theirs own weight. Therefore, the paddle can be paddled to drive the boat forward. For boats without coupling rings, users have to hold the paddles by themselves, and thus users need to pedal with a much larger force to drive the boat. Although a motor boat, usually using vane propellers, does not need manpower to drive, it requires more additional power equipments and energy consumption, and thus increasing the cost.

Regardless of a manual-control boat or a power boat, it is necessary to have a special design for the boat body to save power for a rapid forward movement. The expense of cost and time for this type of boats are usually very high, which is definitely not the most economic arrangement. In view of the description above, designing a manual-control sculling boat assembly for users to drive a boat in a power-saving, economic, and fast manner and meet the manufacturing development trend for new models of the present product demands immediate attention and feasible solutions.

SUMMARY OF THE INVENTION

In view of the description above, it is not difficult for us to find out that a manual-control small boat such as a sculling boat becomes users' favorite as the water sports and recreation industry is booming. Due to the structural design in the past, the cost of manufacture and time were relatively high, which is not definitely an economic arrangement. Therefore, the inventor of the present invention based on years of experience in the related industry to conduct extensive researches and experiments and finally invented a sculling boat assembly to overcome the foregoing shortcomings and meet the actual market and user requirements. With the ingenious ideas of the present invention, a practical and convenient sculling boat assembly is provided for users.

It is therefore a primary objective of the present invention to provide a sculling boat assembly provided for users to control the traveling direction and drive a boat to move forward in a simpler, more power-saving and more economic manner. The sculling boat assembly installs a transmission mechanism on two hulls that are aligned in parallel with each other and maintain a predetermined distance apart. An end of each transmission mechanism is coupled with a handle extended from two hulls, and another end of each transmission mechanism is coupled to a paddle rod extended slightly downward from the tail of the boat. An end of each paddle rod is coupled with an extension disposed at an end of a fin-shape member. Through the change of the transmission of each paddle rod of the present invention, a user just needs to apply a force onto each handle to move it reciprocally along a head and a tail of two hulls to drive the fin-shape member disposed on each paddle rod to create the movements of pushing water outward and enclosing water inward. The water resistance can be timely converted into a reaction by the combination of the soft and hard materials of the fin-shape member and its extension so as to drive the two hulls forward rapidly. The sculling boat assembly of the invention also provides a new model of a manually controlled boat to meet the trend of the fast-changing requirements.

The above and other objects, features and advantages of the present invention will become apparent from the following detailed description taken with the accompanying drawings.

DETAILED DESCRIPTION OF THE PREFERRED EMBODIMENTS

Figure 1:
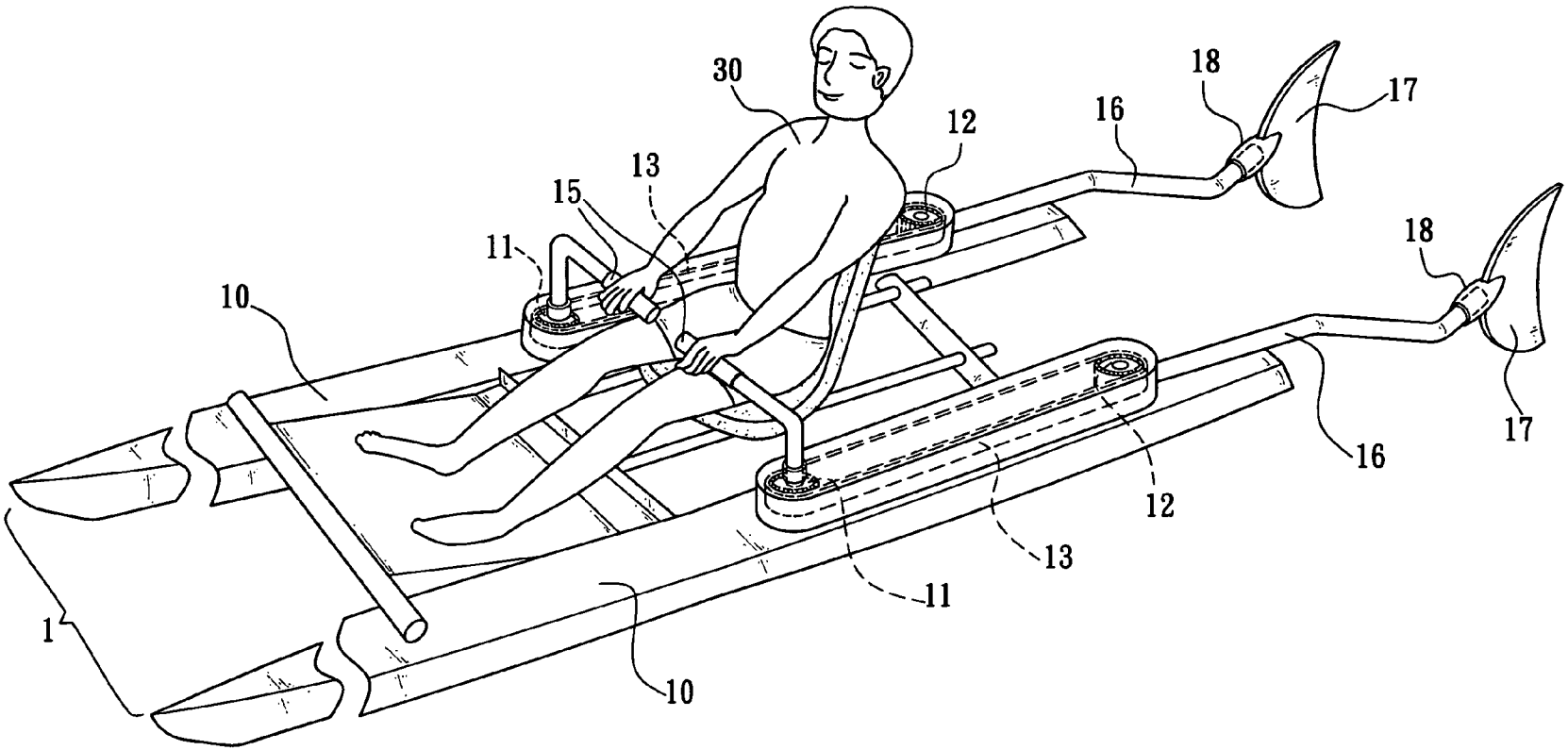
FIG. 1 is a schematic view of a sculling boat in accordance with a preferred embodiment of the present invention.

Referring to FIG. 1, a sculling boat assembly in accordance with a preferred embodiment of the present invention is illustrated. The sculling boat assembly comprises a boat body 1 made of two hulls 10 aligned in parallel with each other and having a predetermined distance apart, and the predetermined distance is provided for carrying a user 30; a first rotary device 11 and a second rotary device 12, being installed proximate to the middle section and the rear section of the two hulls 10 respectively, and both first and second rotary devices 11, 12 are gears adopted in this preferred embodiment; a transmission device 13 being coupled separately to the first rotary device 11 and the second rotary device 12, and the transmission device 13 is a chain adopted in this preferred embodiment; a handle 15, being disposed on the first rotary device 11 and respectively extended into the two hulls 19, and the handle 15 is provided for the user 30 to reciprocally move the handle 15 along a head and a tail of the two hulls 10; a paddle rod 16, being disposed on the second rotary device 12 in a direction slightly downward from a tail of the boat, and one end of the paddle rod 16 is coupled with an extension 18 disposed at a fin-shape member 17, such that the surface of the fin-shape member 17 is perpendicular to the water surface. If the handle 15 is moved reciprocally from the head and tail of the two hulls 10, the first rotary device 11 is turned sideway and the transmission device 13 is driven to drive the fin-shape member 17 disposed at an end of the paddle rod 16 of the second rotary device 12 for the movements of pushing water outward and enclosing water inward.

Referring to FIG. 1 again for the preferred embodiment of the present invention, the fin-shape member 17 is made of a hard material and its extension 18 is made of a soft material, or the fin-shape member 17 is made of a soft material and its extension 18 is made of a hard material, such that when the fin-shape member 17 disposed at one end of the paddle rod 16 is placed into the water for the movements of pushing water outward or enclosing water inward, the water resistance can be timely converted into a reaction by the combination of the soft and hard materials of the fin-shape member 17 and its extension 18, so as to drive the whole boat body 2 forward rapidly. In the meantime, the combination of the soft and hard materials of the fin-shape member 17 and its extension 18 also allows the user 30 to apply forces to the handles 15 in a more convenient and power-saving manner.

Figure 2:
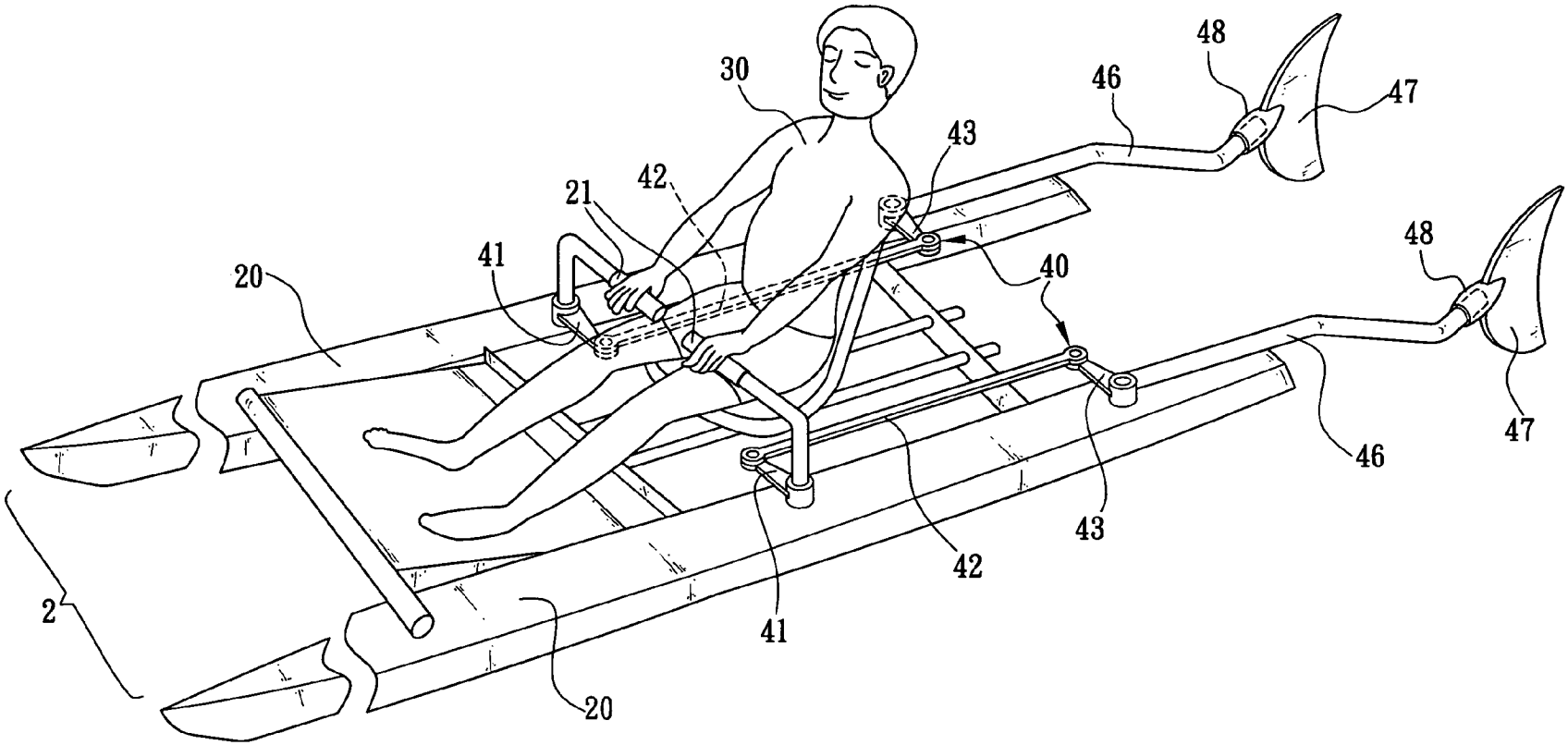
FIG. 2 is a schematic view of a sculling boat in accordance with another preferred embodiment of the present invention.

Referring to FIG. 2 for another preferred embodiment of the present invention, a boat body 2 is made of two hulls 20 aligned in parallel with each other and having a predetermined distance apart, and the predetermine distance is provided for carrying a user 30; a link rod transmission mechanism 40, being disposed proximate to the middle section and the rear section of the two hulls 20 respectively, and the link rod transmission mechanism 40 comprises a first link rod 41, a second link rod 42 coupled to the first link rod 41, a third link rod 43 coupled to the second link rod 42, a handle 21 disposed on one end of the first link rod 41 of the link rod transmission mechanism 40 at a position proximate to the hull 20 and extended from the two hulls 20 to couple with the handle 21. An end of the third link rod 43 of the link rod transmission mechanism 40 proximate to the hulls 20 is coupled to a paddle rod 46 slightly extended downward from the tail of a boat, and an end of the paddle rod 46 is coupled to an extension 48 disposed at an end of a fin-shape member 47, such that the surface of the fin-shape member 47 is perpendicular to the water surface. If the handle 21 is moved reciprocally from a head and a tail of the two hulls 20, the link rod transmission mechanism 40 is driven to drive the fin-shape member 47 disposed at an end of the paddle rod 46 for the movements of pushing water outward and enclosing water inward.

In another preferred embodiment of the present invention, the fin-shape member 47 is made of a hard material and its extension 48 is made of a soft material, or the fin-shape member 47 is made of a soft material and its extension 48 is made of a hard material, such that when the fin-shape member 47 at one end of the paddle rod 46 is placed into the water for the movements of pushing water outward or enclosing water inward, the water resistance can be converted into a reaction timely by the combination of the soft and hard materials of the fin-shape member 47 and its extension 48, so as to drive the whole boat body 2 forward rapidly. In the meantime, the combination of the soft and hard materials of the fin-shape member 47 and its extension 48 also allows the user 30 to apply forces to the handles 21 in a more convenient and power-saving manner.

Figure 3:
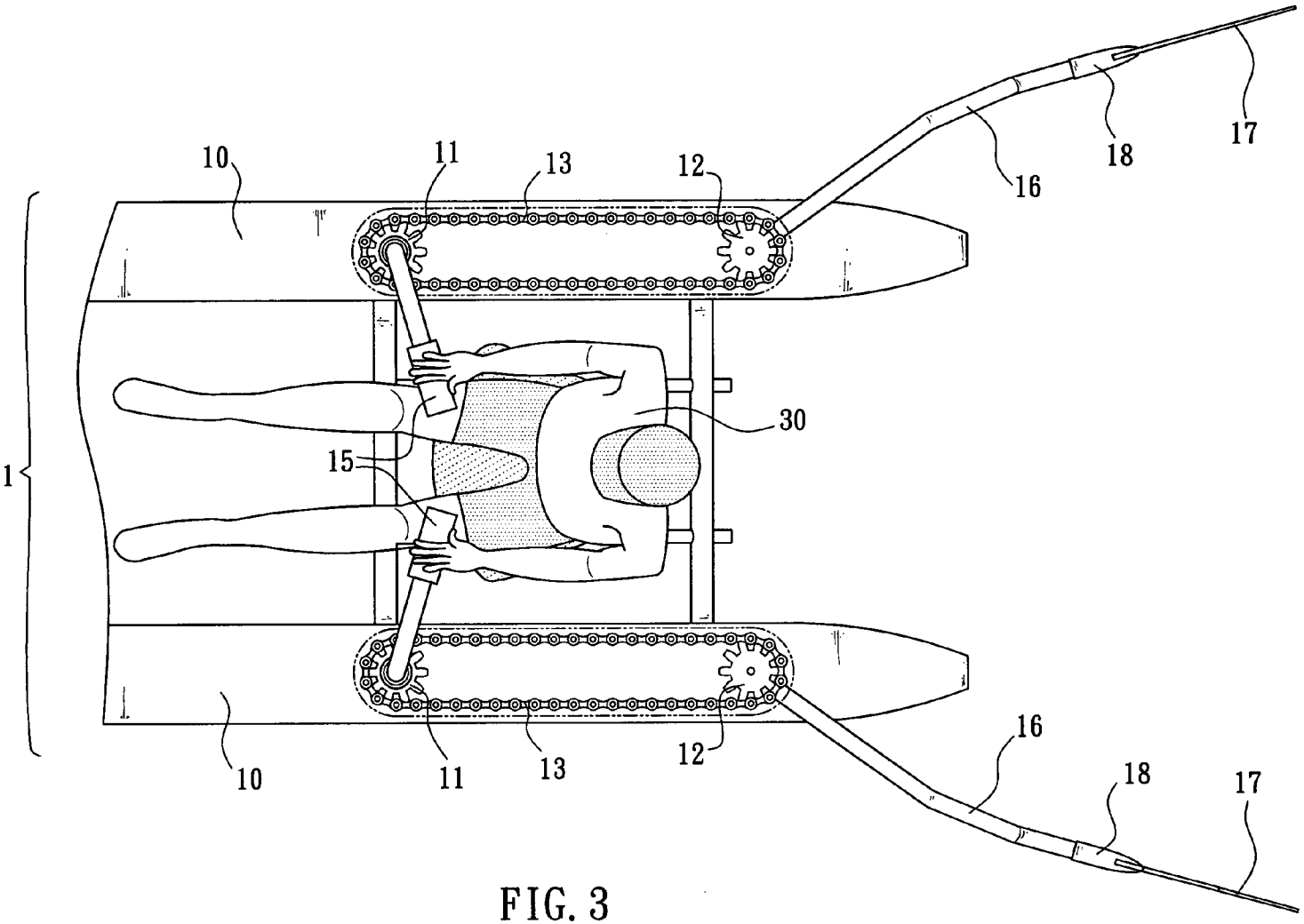
FIG. 3 is a top view of the motion of a sculling boat as depicted in FIG. 1.
Figure 4:
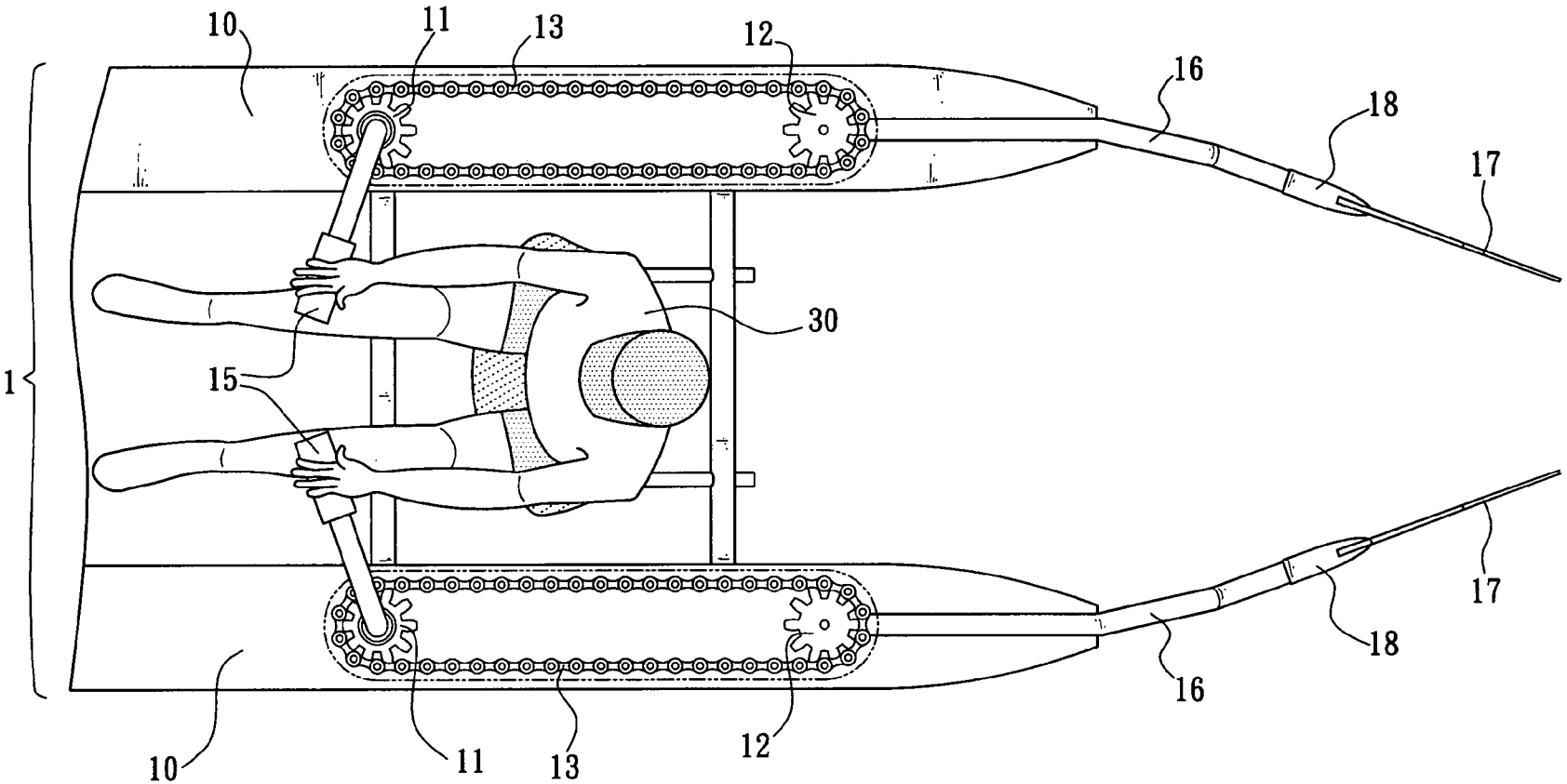
FIG. 4 is another top view of the motion of a sculling boat as depicted in FIG. 1.

With the foregoing components, it is obvious that a user just needs to apply a force on each handle 15, 21 and moves the handle 15, 21 reciprocally along the head and tail of the two hulls 10, 20. Through a change of the transmission of each paddle rod 16, 46 of the present invention, the fin-shape member 17, 47 at another end of the paddle rod 16, 46 can be driven to create the movements of pushing water outward and enclosing water inward as shown in FIGS. 3 and 4. The water resistance can be timely converted into a reaction by the combination of the soft and hard materials of the fin-shape member 17, 47 and its extension 18, 48, so as to drive the two hulls 10, 20 forward rapidly.

The sculling boat assembly of the invention not only has the advantage of being made of simple components, but also allows users 30 to move reciprocally in the most economic and power-saving manner so as to achieve the purposes of controlling the direction of the two hulls 10, 20 and driving the boat forward. In the meantime, the present invention also provides a new model of a manually controlled boat to meet the trend of the fast-changing requirements.

While the invention herein disclosed has been described by means of specific embodiments, numerous modifications and variations could be made thereto by those skilled in the art without departing from the scope and spirit of the invention set forth in the claims.

What is claimed is:

1. A sculling boat assembly, comprising:

a boat body, including two hulls aligned in parallel with each other and having a predetermined distance apart, and said distance is provided for carrying a user;

a first rotary device and a second rotary device, being disposed at a middle section and a tail section of said two hulls respectively, and said first and second rotary device have a transmission device each;

a handle, being disposed on said each rotary device and extended towards said two hulls, for allowing users to move reciprocally along a head and a tail of said two hulls;

a paddle rod, installed on said second rotary device and slightly downward from a tail of said sculling boat, and having an end of said paddle rod being coupled to an extension that is disposed at an end of a fin-shape member, such that the surface of said each fin-shape member is perpendicular to the water surface, and when said handle is moved reciprocally between a head and a tail of said two hulls, said rotary devices are rotated sideway and said each transmission device is driven to drive said fin-shape member disposed at an end of said each paddle rod on said second rotary device to carry out the movements of pushing water outward and enclosing water inward.

2. The sculling boat assembly of claim 1, wherein said first rotary device and said second rotary device are gears.

3. The sculling boat assembly of claim 1, wherein said transmission device is a chain.

4. The sculling boat assembly of claim 1, wherein said fin-shape member is made of a hard material and said extension is made of a soft material for timely converting the water resistance into a reaction to drive said whole boat body to move forward rapidly, while the combination of said hard fin-shape member and said soft extension allows a user to apply a force onto said handle in a more convenient and power-saving manner.

5. The sculling boat assembly of claim 1, wherein said fin-shape member is made of a soft material and said extension is made of a hard material for timely converting the water resistance into a reaction to drive said whole boat body to move forward rapidly, while the combination of said soft fin-shape member and said hard extension allows a user to apply a force onto said handle in a more convenient and power-saving manner.

6. A sculling boat assembly, comprising:

a boat body, including two hulls aligned in parallel with each other and having a predetermined distance apart, and said distance is provided for carrying a user;

a link rod transmission mechanism, being disposed on a middle section and a tail section proximate to said two hulls separately and including a first link rod, a second link rod coupled to said first link rod, and a third link rod coupled to said second link rod;

a handle, being extended separately from said two hulls to couple with an end of said first link rod of said link rod transmission mechanism at a position proximate to said boat body;

a paddle rod, being extended slightly downward along a tail direction of said sculling boat and having another end of said paddle rod pivotally coupled with said third link rod of said link rod transmission mechanism at a position proximate to said boat body, and an end of said paddle rod is coupled to an extension at an end of a fin-shape member, such that the surface of said each fin-shape member is perpendicular to the water surface, and when said handle is moved reciprocally between a head and a tail of said two hulls, said rotary devices are rotated sideway and said each transmission device is driven to drive said fin-shape member disposed at an end of said each paddle rod on said second rotary device to carry out the movements of pushing water outward and enclosing water inward.

7. The sculling boat assembly of claim 6, wherein said fin-shape member is made of a hard material and said extension is made of a soft material for timely converting the water resistance into a reaction to drive said whole boat body to move forward rapidly, while the combination of said hard fin-shape member and said soft extension allows a user to apply a force onto said handle in a more convenient and power-saving manner.

8. The sculling boat assembly of claim 1, wherein said fin-shape member is made of a soft material and said extension is made of a hard material for timely converting the water resistance into a reaction to drive said whole boat body to move forward rapidly, while the combination of said soft fin-shape member and said hard extension allows a user to apply a force onto said handle in a more convenient and power-saving manner.

* * * * *